US006413480B1

(12) United States Patent
Vishnevsky

(10) Patent No.: US 6,413,480 B1
(45) Date of Patent: Jul. 2, 2002

(54) METHOD OF SEPARATION OF HYDROCARBON OILS FROM A WAXY FEEDSTOCK AND SEPARATION SYSTEM FOR IMPLEMENTATION OF SAID METHOD

(75) Inventor: Anatoly Vishnevsky, Hafia (IL)

(73) Assignee: Yutec Technologies, Inc., Haifa Bay (IL)

( * ) Notice: Subject to any disclaimer, the term of this patent is extended or adjusted under 35 U.S.C. 154(b) by 0 days.

(21) Appl. No.: 09/532,317

(22) Filed: Mar. 22, 2000

(51) Int. Cl.[7] ..... B01D 9/02

(52) U.S. Cl. ..... 422/254; 422/188; 422/193; 422/195; 422/198; 585/812

(58) Field of Search ..... 422/188, 193, 422/195, 198, 254; 585/812

(56) References Cited

U.S. PATENT DOCUMENTS 3,199,959 A * 3/1958 Dempsey ..... 422/193
4,486,395 A 4/1984 Witte et al. ..... 422/254
5,196,116 A * 3/1993 Ackerson et al. ..... 208/33
5,510,542 A * 4/1996 Jakobson et al. ..... 568/680

OTHER PUBLICATIONS

Abramovich et al., "Ultrasound Effect on Oil Dewaxing Process," in Chemistry and Technology of Fuels and Oils, No. 3 (1965) in Russian. English translation.*

S. Abramovich et al., —Ultrasound effect on oil dewaxing processing, No. 3, 1965; From"Chemistry and Technology of Fuels and Oils" (In Russian).

Sequeira—Lubricant base oil and was processing, 1994, pp. 167–169 (Excerpts).

* cited by examiner

*Primary Examiner*—Jerry D. Johnson
*Assistant Examiner*—Frederick Varcoe
(74) *Attorney, Agent, or Firm*—Blank Rome Comisky & McCauley LLP

(57) ABSTRACT

Apparatus for separating wax from a feedstock mixture comprising solvent and a wax component is described. The apparatus includes a crystallization column and a plurality of compartments for forming the crystallized wax. Scraping means are employed to resume the crystallized wax for recovery by a filter.

10 Claims, 4 Drawing Sheets

METHOD OF SEPARATION OF HYDROCARBON OILS FROM A WAXY FEEDSTOCK AND SEPARATION SYSTEM FOR IMPLEMENTATION OF SAID METHOD

FIELD OF THE INVENTION

The present invention relates to petroleum processing, in particular to lubricant base oil and wax manufacture. The invention concerns the process of separation of petroleum wax from the occluded oil by virtue of precipitation of crystallized wax from the waxy feedstock and subsequent filtering and evacuation of the soft and hard wax from the mixture of dewaxed oil and solvent.

BACKGROUND OF THE INVENTION

There are known numerous publications describing separating of petroleum wax from hydrocarbon oils in a waxy feedstock. The processes employed for this purpose are based on crystallization of wax from the feedstock, which is a mixture of slack wax, solvent and oil.

An example of such a process can be found in U.S. Pat. No. 5,196,116 in which there is disclosed a process for solvent dewaxing of a waxy oil feed to obtain petroleum oil lubricating stock. The process comprises the step of contacting of a warm waxy oil feed by indirect heat exchange first with cold filtrate and then with refrigerant to crystallize and precipitate the wax in the oil feed to form an oil/solvent/wax mixture. The disadvantage of this method is associated with the fact that it is not suitable to separation of petroleum oils having low pour point.

Typical method of crystallization can be found in a book "Lubricant base oil and wax processing" p. 167–169, 1994 by Avelino Sequeira. According to this method the waxy feedstock is heated to 10–15 Degrees F above the cloud point of the oil/wax/solvent mixture and is diluted with a solvent while chilling at a controlled rate in double-pipe scraped surface exchanger and chiller. The shortcoming of this method is low filtration rate of the slurry and low yield of dewaxed oil and hard wax.

Unfortunately the known in the art methods of crystallization are not sufficiently efficient, since they can not ensure full separation of oils occluded within dendrite structure of crystallized wax.

There is known also an attempt to utilize ultrasonic energy for improving efficiency of the oil dewaxing process as described in an article "Ultrasound effect on oil dewaxing process" by S. Abramovich et al., "Chemistry and Technology of Fuels and Oils", No. 3, 1965, pp. 29–33. In accordance with this method ultrasonic energy of up to 2.5 kW was applied on laboratory scale to an oil-wax-solvent composition at 40 Degrees C and at cooling rate 120 Degrees C per hour. It has been revealed that ultrasonic treatment causes de-agglomeration of dendrites and thus may to a certain extent improve filtration rate and increase dewaxed oil yield. It has been observed however that ultrasonic treatment is effective only under 6–10 Degrees C below the cloud point. Further treatment under lower temperatures was ineffective because of the significant presence of solid phase in the mix and significant absorption of the ultrasonic energy. Due to the absorption one part of the crystals melts and the other part remains untreated at all. It can be assumed that the above phenomenon should be even more pronounced if the treatment is carried out on industrial scale, since it requires higher levels of ultrasonic energy.

Therefore despite numerous references disclosing technology of separation of hydrocarbon oils from petroleum wax there is nevertheless still felt a need in a new and improved method of separation.

SUMMARY OF THE INVENTION

The main object of the present invention is to provide for a new and improved method of separation and an apparatus for its implementation which will sufficiently reduce or overcome the above mentioned drawbacks of the known-in-the-art methods and apparatuses.

In particular the first other object of the invention is to provide for a new method of separation, which is based on crystallization of wax crystals and applying of ultrasonic energy to induce excretion of the occluded oils without however melting of the wax crystals.

Still further object of the invention is to provide for a new and improved method of separation and a system for its implementation in which the crystallization process is not deteriorated due to generation of heat associated with the applying of ultrasonic energy.

Yet another object of the present invention is to provide for a new and improved method of separation and a system for its implementation, which is not limited to the low pour point oils, which allows efficient separation with increased slurry filtration rate and which results in improved yield of dewaxed oil and hard wax.

For a better understanding of the present invention as well of its benefits and advantages, reference will now be made to the following description of its embodiments taken in combination with the accompanying drawings.

DETAILED DESCRIPTION OF SPECIFIC EMBODIMENTS

Figure 1:
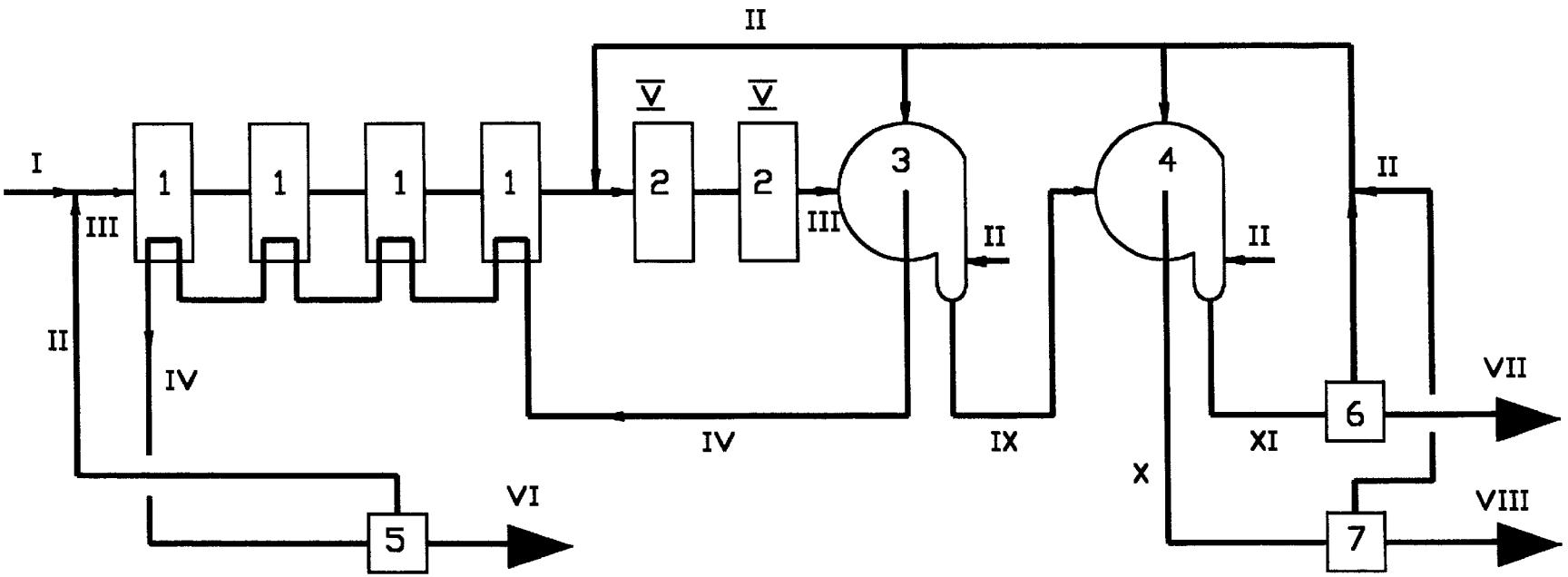
FIG. 1 depicts prior art flow chart diagram of a separation process based on crystalization of wax crystals.

With reference to FIG. 1 it is shown flow chart diagram of a typical prior art process of separation of hydrocarbon oils from wax. The flows of various materials participating in the separation process are designated by Roman numerals and the various items of the equipment used for implementation of the separation process are designated by Arabic numerals. As seen in FIG. 1 to a feed I consisting of wax and oil is added a solvent II and their mixture in the form of homogeneous waxy feedstock III passes the sequence of crystallization chambers. In the chambers the waxy feedstock is chilled, crystallization of wax is initiated and it precipitates in the form of agglomerated crystals. As a suitable solvent one can use acetone, methyl ethyl ketone, methyl isobutyl ketone, propane, toluene, benzene, monohydroxy alcohols or their mixtures. As suitable crystallization chamber one can use for example double pipe scraped surface exchangers and chillers as described in the above-cited book of Sequeira Avilino.

The waxy feedstock becomes a slurry and is chilled in the crystallization chambers by a liquid cooling agent IV, which is pumped through the chambers opposite to the flow direction of the slurry. As a cooling agent one can use water or mixture of dewaxed oil and solvent, which is produced during the further step of the separation process.

After passing the first sequence of crystallization chamber 1 the slurry proceeds to the second sequence of crystallization chambers 2. These chambers are cooled by a dedicated refrigerant, e.g. propane, or ammonia. After the crystallization process is completed the slurry proceeds to a filter 3, in which a mixture IX of slack wax and solvent is separated from a mixture IV of dewaxed oil and solvent. The slack wax/solvent mix proceeds further to a filter 4, in which a mixture of soft wax and solvent is separated from a mixture XI of hard wax and solvent. The dewaxed oil/solvent mix IV is returned to the system and is used for cooling the first sequence of crystallization chambers.

The last stages of separation are carried out in a recovery section 6, in which hard wax VII is separated from the hard wax/solvent mix XI and in a recovery section 7, in which soft wax VIII is separated from the soft wax/solvent mix X. The soft and hard wax is collected and the solvent is returned to the system.

The mixture IV of dewaxed oil and solvent proceeds to a recovery section 5, in which dewaxed oil VI is separated and collected. The solvent II is returned to the system for mixing with the wax oil feed.

Figure 2:
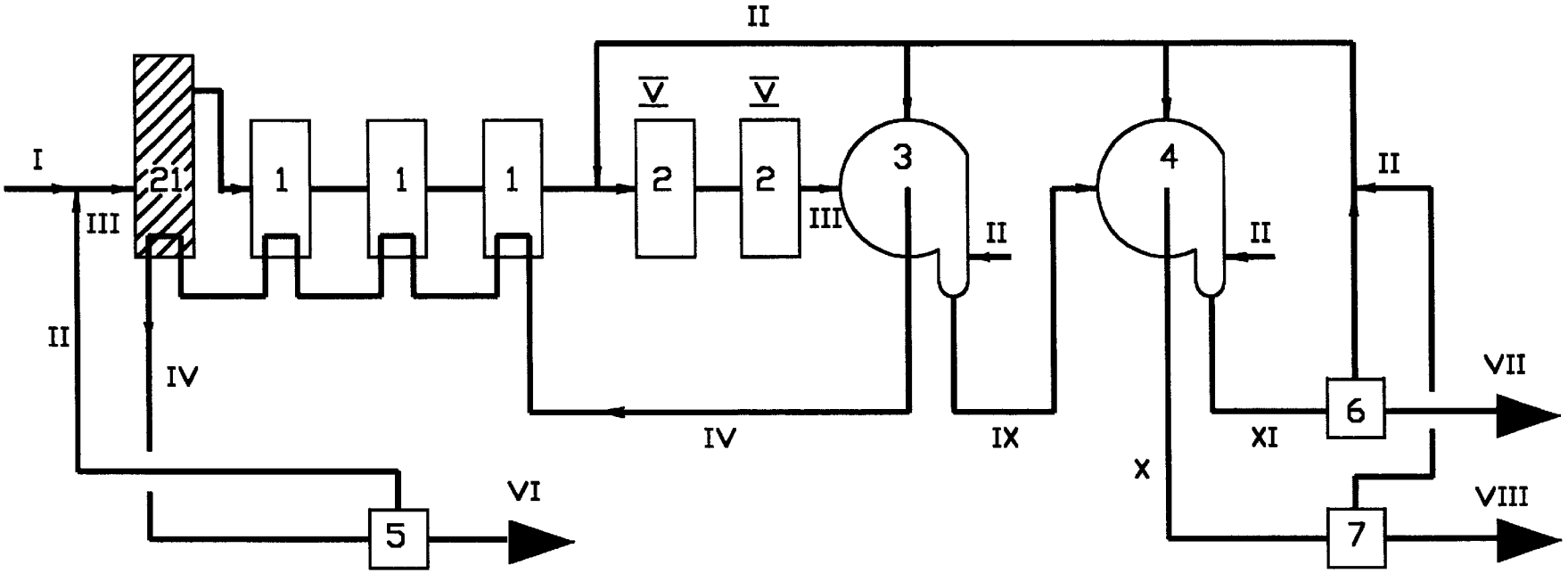
FIG. 2 is flow chart diagram of a separation process of the present invention.

Referring to FIG. 2 it is shown flow chart diagram of a separation process of the present invention. The main steps thereof are in principle similar to those of the prior art process described above. However in contrast to the prior art process in the present invention is employed crystallization process assisted by the applying of ultrasonic field. The waxy feedstock III proceeds to a dedicated crystallization unit 21 provided with at least one ultrasonic processor USP capable to create ultrasonic field preferably with intensity of 0.1–5 W/cm$^2$ and to submit ultrasonic vibrations to the slurry during the crystallization process. By virtue of this provision the agglomerates of wax crystals are destroyed and residual occluded oil is excreted. The specific parameters of the crystallization process and unique constructional features of the dedicated crystallization unit will be explained further in more details. These parameters and features ensure very efficient excretion of the occluded oil without deterioration of the crystallization process and thus enable to improve the efficiency of separation.

After passing the dedicated crystallization unit 21 the feedstock slurry proceeds further to the conventional crystallization chambers 1 which are similar to those mentioned above in connection with the prior art separation process. The other steps of the separation process of the invention are similar to those of the prior art and therefore the same numerals are used for the designation of the same elements in FIGS. 1,2.

In accordance with the present invention the amount of the heat energy to be evacuated from the crystallization chamber should exceed the amount of the heat energy that is required to evacuate solely for the inducing crystallization and compensating for the associated latent heat of crystallization. It has been empirically revealed that the total amount of evacuated heat energy should be enough also to compensate for the heat generated by the ultrasonic processor since this heat causes melting of wax crystals, limits the rate of filtration and thus reduces the efficiency of separation. In practice to satisfy the above condition the cooling agent should be supplied to the crystallization chamber in the amount sufficient for evacuating of at least 9000–10000 cal/hr per kg of feedstock.

It has been also emprically revealed that in order to satisfy the above criteria the overal heat transfer coefficient should be kept of at least 300 Kcal/m$^{2}$·° C.·hr. In order to obtain the above value of the overal heat transfer coefficient one can use homogenization of the structural viscosity of the slurry, for example by mixing thereof.

It is especially advantageous if the mixing action is carried out by rotating mechanical scarpers, which rotate with peripheral linear velosity of 0.5–0.9 m/sec.

In accordance with still further embodiment of the invention, it is recommended to scrape the crystals during their crystallization since this measure intensifies the heat exchange and improves conditions for nucleation and growth of wax crystals.

Figure 3:
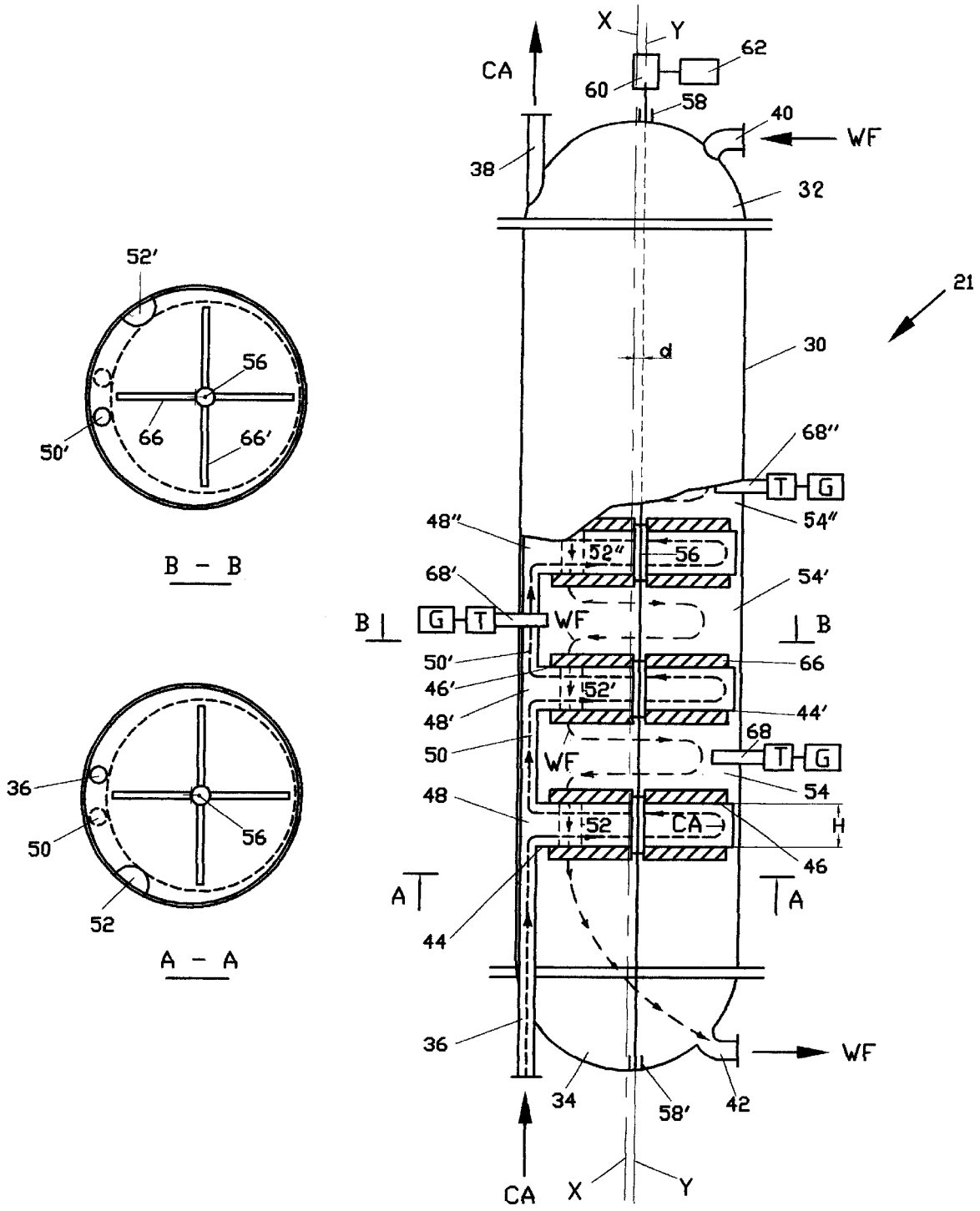
FIG. 3 presents schematically crystallization chamber of the separation system of the present invention along with cross-sections A—A and B—B thereof.
Figure 4:
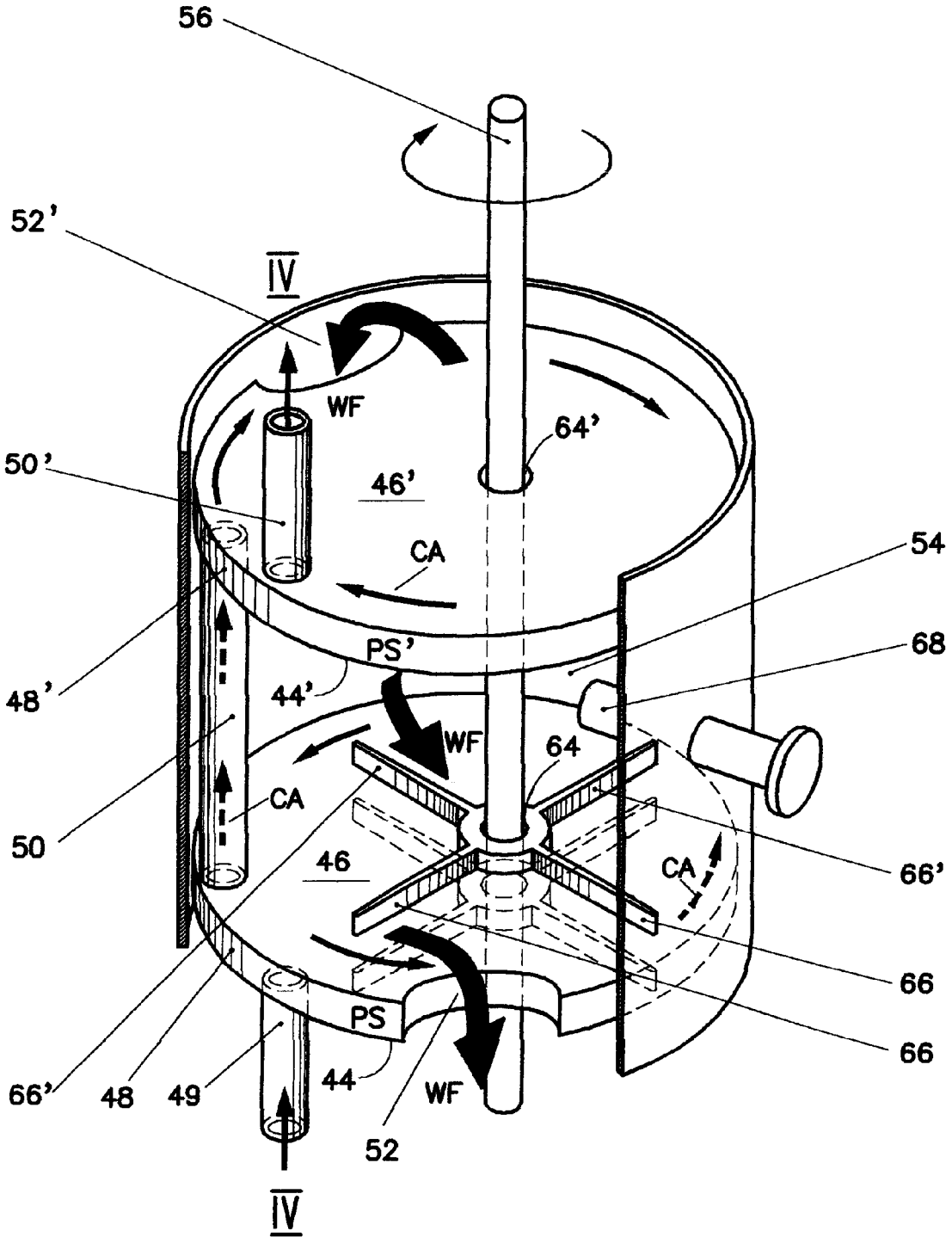
FIG. 4 is partial isometric view of a fragment of the crystallization chamber shown in FIG. 3.

Having explained in general the peculiarities of the separation method according to the invention it will be disclosed now with reference to FIGS. 3,4 the construction of dedicated crystallization chamber 21 used for the implementation of this method.

The chamber is formed as elongated cylindrical column 30 defined by an outer shell and an upper cover 32 and a lower cover 34. The column is preferably oriented in such a manner that its longitudinal central axis X—X is vertical. Within the lower part of the outer shell is made an inlet 36 for entering of a cooling agent (CA), and in the upper part of the shell is made an outlet 38 for the exit of the cooling agent. The cooling agent is forcibly driven through the column for example by appropriate pumping means (not shown). As appropriate cooling agent one can use water but it is preferable if the cooling agent is a mixture IV of dewaxed oil and solvent as shown in FIG. 2.

In the upper cover 32 of the column is made an inlet 40 for entering of a waxy feedstock III (WF) consisting of a mixture of wax oil and solvent. The feedstock enters the column through inlet 40 and proceeds by virtue of gravitation down to the outlet 42 made in the lower cover.

Within the major part of the column's interior reside plurality of partitions 44,46 dividing the column into sections. The partitions are formed as substantially disk like plates, which are mounted within the column so as to be perpendicular to the longitudinal axis X—X of the chamber. The adjacent partitions are connected by a peripheral cylindrical surface configured to match the inwardly facing surface of the shell. By virtue of this provision the interior of the column is divided into disk like compartments, defined by a height dimension H. The outside diameter of the compartments is less than the inside diameter of the column. The disk like compartments are arranged within the chamber in such a manner that their centers are not co-axial with the central longitudinal axis X—X. The advantage of this arrangement will be explained further.

In FIG. 3 one can see for example, that between partitions 44,46 there is provided compartment 48 and between partitions 44', 46' there is provided compartment 48'.

The compartments communicate each other via tubular connections, which extend parallel to the axis X—X from one compartment to the adjacent compartment. The concessive tubular connections, inlet 36 and outlet 38 are not in alignment and are arranged in such a manner that they reside on the same side with respect to the longitudinal central axis X—X of the chamber. For example it is seen in FIG. 3, that tubular connection 50 enabling communication of compartment 48 with compartment 48' is not in alignment with the concessive tubular connection 50' enabling communication between compartment 48' and compartment 48". It can be seen also in cross-section A—A, that tubular connection 50 and inlet 36 reside on the same left side with respect to the central axis X—X, shown schematically as cross.

By virtue of this provision there is provided a path for movement of the cooling agent passing through the interior of the chamber. This path is designated by arrow CA.

Each of the compartments is provided with a concavity 52 formed on the peripheral surface thereof so as to enable communication between those regions of the column, which are out of the compartments and interspace therewith. It can be appreciated that by virtue of this provision the regions communicate independently of the compartments, i.e. the fluid flowing through the regions is not in physical contact with the fluid flowing through the compartments.

In FIG. 3 one can see, for example, a region 54 situated between compartment 48 and compartment 48'. Situated between compartment 48' and compartment 48" a sequential region 54' communicates with region 54 via a concavity 52' made in the peripheral surface of the compartment 48'. Sequential with region 54' there is provided a region 54". Region 54' communicates with region 54" via a concavity 52" made in the peripheral surface of the compartment 48".

It is advantageous if the compartments are arranged in such a manner that concavities made in the peripheral surfaces of sequentially situated compartments are not aligned, as it is shown in FIG. 3. By virtue of this provision there is created a path for the flow of waxy feedstock III sequentially passing between the regions. This path is designated by arrow WF.

The crystallization chamber is provided also with at least one ultrasonic processor, consisting of a sonotrode, protruding through the shell towards the column interior. and connected with a transducer and generator. The sonotrode protrudes within at least one region of the column so as to submit ultrasonic vibrations to the feedstock passing therethrough. It is advantageous if the column is provided with several ultrasonic processors as shown in FIG. 3. It can be seen that sonotrodes 68,68', 68" protrude respectively within regions 54,54' and 54". Each sonotrode is connected to a dedicated transducer T and generator G. It has been empirically found that the power of the generator should be suffucient to create ultrasonic field with intensity 0.1–5 $w/cm^2$.

It is advantageous if those regions where the feedstock is ultrasonically treated are located in the lower part of the column. By virtue of this provision the ultrasonic treatment is applied to the feedstock, which is already cooled to the required temperature and in which the crystallization process has been initiated.

The column is provided with a central shaft 56 extending parallel the longitudinal axis X—X and passing via central through-going openings 64 made in the partitions (see FIG. 4). The shaft is mounted in bearings 58,58' situated correspondingly in the upper and lower cover 32,34 of the column and thus it can be rotated by a gear 60, driven by a motor 62. The shaft carries a plurality of scraper means, connected to the shaft so as to rotate therewith. The scraper means can be formed for example as two crossing scrapers 66,66'. The scrapers reside on the shaft so as to be in proximity with the outwardly facing surfaces of the partitions and thus to scrape the crystals growing thereon.

It is of advantage if the centers of the disk like compartments reside along longitudinal axis Y—Y, which is parallel to the longitudinal axis X—X and is displaced therefrom by a small distance d. The shaft 56 extends along the axis Y—Y as well.

By virtue of this provision the chamber interior is used more efficiently, since the outside diameter of disk like partitions can be increased.

It can be appreciated that this is associated with increasing the surface scraped by the scrapers and thus with their more efficient functioning.

Continuous scraping of the growing crystals prevents overgroving of crystals and at the same time homoginizes the viscosity of the feedstock, since scrapers function as a mixer. In practice it is especially advantageous in terms of desired overall heat transfer coefficient if the peripheral linear velocity of the scrapers is in the range of 0.5–0.9 m/sec. p With reference to FIG. 4 a fragment of the column is shown. In this fragment are seen disc like compartments 48,48' defined correspondingly by lower and upper partitions 44,46 and 44',46' as well by peripheral surfaces PS,PS'. The adjacent compartments communicate via tubular connections 49,50. The cooling agent IV enters the compartment 48 via tubular connection 49 and then flows along arrow CA to the compartment 48' and further to the adjacent compartment via tubular connection 50'. It is seen that connection 50' is not aligned with the connection 50.

Concavities 52,52' formed in the peripheral surfaces of compartments 48,48' are also seen. By virtue of these concavities the region 54 situated between the adjacent compartments can communicate with those regions of the column which situate under compartment 48 and above compartment 48'. The flow of waxy feedstock is shown by thick arrows WF and since the concavities are not in alignment the feedstock flows along a serpentine path. It is also seen that the cooling agent flows opposite to the feedstock and the heat exchange therebetween is effected via the disk like partitions of the compartments.

Circular through-going central openings 64,64' are made in the compartments so as to enable passing of the shaft therethrough. The shaft can rotate for example in clockwise direction shown by an arrow. Scrapers 66,66' are affixed in crosswise fashion to the shaft to be in close proximity to the outwardly facing surface of partition 46.

Protruding inside the region 54 a sonotrode 68 is shown. The sonotrode submits ultrasonic vibrations to the feedstock, while it passes region 54.

It is not shown specifically but should be understood that the column is also equipped with appropriate instrumentation for measuring and controlling of various parameters of the process, e.g. cooling temperature, flow rate, pressure, etc.

Now with reference to non-limiting Example 1 and Table 1 it will be described how the present invention was implemented in practice for separating of petroleum based oils from wax.

EXAMPLE 1

Slurry of feedstock mixture of Raffinate SAE-10 and Methyl Ethyl Ketone (MEK) and Toluene was treated. The Raffinate was selectively purified from n-Methyl-2-Pyrolidone by Furfurol. The viscosity of the Raffinate was 510 Saybolt Universal SSU.

The initial Raffinate to Solvent ratio in volume percents was 1:1. The cloud point of the feedstock was 43° C.

The separation was carried out in a system provided with crystallization chamber as described above. Water was used as a cooling agent during the crystallization step assisted by ultrasonic vibration.

Temperature was kept −12 degrees C.

Some parameters of the crystallization step along with the obtained results of separation in terms of filtraton rate, dewaxed oil yield and hard wax yield are summarized in non-limiting Table 1 below. The data is compared with the same data obtained for conventional separation method as described in the above-cited book of Sequeira Avilino.

TABLE 1

| Parameters | Prior art | Test 1 | Test 2 | Test 3 | Test 4 | Test 5 | Test 6 | Test 7 | Test 8 | Test 9 |
|---|---|---|---|---|---|---|---|---|---|---|
| Feedstock flow rate, 1/hr | 26.6 | 26.5 | 26.4 | 26.7 | 26.0 | 25.9 | 26.1 | 26.7 | 26.0 | 25.8 |
| Feedstock inlet temp. Degrees C. | 43 | 43.1 | 43.2 | 43.1 | 43.0 | 43.4 | 43.0 | 43.0 | 43.4 | 43.3 |
| Feedstock outlet temp. Degrees C. | 32.2 | 32.2 | 32.7 | 32.1 | 31.9 | 32.2 | 32.0 | 32.0 | 31.8 | 31.8 |
| Water inlet temp. degrees C. | 28.1 | 27.9 | 27.8 | 28.0 | 28.2 | 28.1 | 27.9 | 28.0 | 28.1 | 28.2 |
| Water outlet temp. Degrees C. | 32.9 | 31.2 | 31.1 | 31.4 | 31.5 | 31.3 | 31.4 | 31.0 | 31.9 | 31.4 |
| Scrapers peripheral velocity, m/sec | 0.25 | 0.7 | 0.7 | 0.7 | 0.7 | 0.7 | 0.4 | 0.5 | 0.9 | 1.0 |
| Overall heat transfer coefficient, $kcal/m^2 \cdot {}^\circ C. \cdot hr$ | 170 | 374 | 371 | 373 | 372 | 372 | 243 | 301 | 365 | 403 |
| Ultrasonic field intensity, $W/cm^2$ | | 0.09 | 0.1 | 1.2 | 5.0 | 5.1 | 1.2 | 1.2 | 1.2 | 1.2 |
| Slurry filtration rate, $cm^3/cm^2 \cdot sec$ | 0.18 | 0.19 | 0.22 | 0.34 | 0.26 | 0.18 | 0.20 | 0.27 | 0.24 | 0.17 |
| Dewaxed oil yield, weight % | 66.4 | 66.4 | 66.9 | 72.3 | 68.2 | 66.5 | 66.2 | 69.8 | 70.9 | 66.4 |
| Hard wax yield, weight % | 13.0 | 13.0 | 13.9 | 17.0 | 16.1 | 12.9 | 13.1 | 15.9 | 16.4 | 13.1 |

It can be seen that if the overall heat transfer coefficient during the crystallization step is at least 300 $Kcal/m^2 \cdot {}^\circ C. \cdot hr$ then filtration rate increases by a factor 1.5, hard wax yield increases by a factor 1.22 and dewaxed oil yield increases by a factor 1.05 (compare test 7 and prior art), .

If peripheral velocity of scrapers is kept within 0.5–0.9 m/sec then filtration rate increases by a factor 1.5–1.9, hard wax yield increases by a factor 1.22–1.31, and dewaxed oil yield increases by a factor 1.05–1.09 (compare tests 7,3 and prior art).

If ultrasonic field intensity is kept in the range 0.1–5 $W/cm^2$, then filtration rate increases by a factor 1.22–1.44, hard wax yield increases by a factor 1.07–1.24 and dewaxed oil yield increases by a factor 1.01–1.03 (compare tests 2,4 and prior art).

It should be appreciated that the present invention is not limited to the above-described embodiments and that changes and one ordinarily skilled in the art can make modifications without deviation from the scope of the invention, as will be defined in the appended claims.

It should also be appreciated that the features disclosed in the foregoing description, and/or in the following claims, and/or in the accompanying drawings may, both separately and in any combination thereof, be material for realizing the present invention in diverse forms thereof.

What is claimed is:

1. A system for separating hydrocarbon oils and wax from a waxy feedstock mixture containing an oil-containing wax component and a solvent component, said system comprising at least one crystallization chamber in which said waxy feedstock is cooled and crystallization of wax crystal is induced, said chamber is formed as a column, defined by a tubular body portion closed by an upper and a lower cover, said tubular body portion is provided with an inlet for entering a cooling agent thereinto and an outlet for exit of the cooling agent, said upper cover is provided with an inlet for entering the feed stock mixture and said lower cover is provided with an outlet for exit thereof, wherein the interior of the body portion is divide into plurality of successive hollow compartments, each of said compartments is defined by two opposite lateral disk surfaces and by an annular peripheral surface, the successive compartments are connected by tubular connections so as to be in communication and to allow the flow of cooling agent therethrough, the annular peripheral surface of each compartment is formed with at least one concavity so as to enable communication between the successive regions and to allow the flow of feed stock therethrough; said column further including scraping means affixed to a rotatable vertical shaft for scraping said wax crystals formed on said disk surface.

2. The system for separation as defined in claim 1, in which the tubular connections connecting the successive compartments are not in alignment and reside on the same side of the compartments with respect to the central longitudinal axis of the column.

3. The system for separation as defined in claim 1, in which the concavities formed on periphery surfaces of successive compartments are not in alignment.

4. The system for separation as defined in claim 1, in which said column is provided with a drive means capable for rotating said scraping means with a peripheral velocity of at least 0.5 m/sec.

5. The system for separation as defined in claim 1, in which said column is provided with at least one ultrasonic processor, said processing comprises a sonotrode, connected to a transducer and a generator, said sonotrode protrudes within the interior of the crystallization chamber so as to submit ultrasonic vibrations to the feedstock.

6. The system for separation as defined in claim 5, in which said ultrasonic processor is capable to create ultrasound field with intensity of 0.1–5 $w/cm^2$.

7. The system for separation as defined in claim 1, wherein said scraping means includes a mechanical scraper affixed to a rotatable shaft and having a plurality of scraping blades, said scraper shaft having a longitudinal axis which is laterally displaced from the longitudinal axis of said column.

8. The system for separation as defined in claim 4, wherein said scraping means includes a mechanical scraper affixed to a rotatable shaft and having a plurality of scraping blades, said scraper shaft having a longitudinal axis which is laterally displaced from the longitudinal axis of said column.

9. The system for separation as defined in claim 5, wherein said scraping means includes a mechanical scraper affixed to a rotatable shaft and having a plurality of scraping blades, said scraper shaft having a longitudinal axis which is laterally displaced from the longitudinal axis of said column.

10. The system for separation as defined in claim 6, wherein said scraping means includes a mechanical scraper affixed to a rotatable shaft and having a plurality of scraping blades, said scraper shaft having a longitudinal axis which is laterally displaced from the longitudinal axis of said column.

* * * * *